US006189215B1

(12) United States Patent
Beerwerth et al.

(10) Patent No.: US 6,189,215 B1
(45) Date of Patent: Feb. 20, 2001

(54) METHOD FOR DATA TRANSMISSION BETWEEN A SHAVING APPARATUS AND A CLEANING DEVICE

(75) Inventors: Frank Beerwerth, Runkel; Wolfgang Brey, Kronberg; Norbert Geister, Eppstein, all of (DE)

(73) Assignee: Braun GmbH (DE)

( * ) Notice: Under 35 U.S.C. 154(b), the term of this patent shall be extended for 0 days.

(21) Appl. No.: 09/125,497

(22) PCT Filed: Dec. 23, 1996

(86) PCT No.: PCT/EP96/05819

§ 371 Date: Aug. 19, 1998

§ 102(e) Date: Aug. 19, 1998

(87) PCT Pub. No.: WO97/30827

PCT Pub. Date: Aug. 28, 1997

(30) Foreign Application Priority Data

Feb. 23, 1996 (DE) ..... 196 06 719

(51) Int. Cl.[7] ..... B26D 19/44
(52) U.S. Cl. ..... 30/42; 30/32
(58) Field of Search ..... 30/41.7, 41.8, 30/41.5, 43.92, 41, 34.05

(56) References Cited

U.S. PATENT DOCUMENTS

| | | | | |
|---|---|---|---|---|
| 3,252,335 | * | 5/1966 | Eisner | 30/43.92 |
| 4,112,271 | * | 9/1978 | Marchetti | 30/43.92 |
| 5,111,580 | | 5/1992 | Bosscha et al. . | |
| 5,240,107 | * | 8/1993 | Casale | 30/41.7 |
| 5,347,715 | * | 9/1994 | Friedland | 30/41.7 |
| 5,421,286 | * | 6/1995 | McLean | 30/41.7 |
| 5,600,888 | * | 2/1997 | Becker | 30/41.7 |
| 5,606,798 | * | 3/1997 | Kelman | 30/41.5 |
| 5,884,404 | * | 3/1999 | Ohle et al. | 30/43.92 |
| 5,920,988 | * | 7/1999 | Momose | 30/41.7 |

FOREIGN PATENT DOCUMENTS

| | | |
|---|---|---|
| 0 432 849 | 6/1991 | (EP) . |
| 61-073031 | 4/1986 | (JP) . |
| 2-241480 | 9/1990 | (JP) . |
| 4-314485 | 11/1992 | (JP) . |
| 6-210080 | 8/1994 | (JP) . |

* cited by examiner

*Primary Examiner*—M. Rachuba
*Assistant Examiner*—Omar Flores-Sánchez
(74) *Attorney, Agent, or Firm*—Fish & Richardson P.C.

(57) ABSTRACT

The invention is directed to a method for data transmission between a shaving apparatus and a cleaning device, said shaving apparatus comprising a device for determining the soiling, said device outputting a soiling signal, if necessary, wherein said signal is outputted by remote data transmission or via a power connection of said shaving apparatus (101) and transmitted to said cleaning device (801).

7 Claims, 3 Drawing Sheets

METHOD FOR DATA TRANSMISSION BETWEEN A SHAVING APPARATUS AND A CLEANING DEVICE

This invention relates to a method for data transmission between a shaving apparatus and a cleaning device.

From U.S. Pat. No. 5,111,580 there is already known a method by which the need to clean a shaving apparatus is indicated by purely time-controlled means.

From JP 61-220 688 A1 there is also known a solution by which the soiling of the shaving head by shaving dust is determined by means of visual methods.

It is possible to keep the shaving apparatus in a mounting device which either doubles as a cleaning device for the shaving apparatus or is coupled to such a cleaning device. So as not to activate the cleaning device each time the shaving apparatus is inserted, thereby causing a certain consumption of cleaning fluid, it is an advantage to limit the frequency with which the cleaning device is activated. Basically it is conceivable for the cleaning device to be activated by the user by pressing a button, for example. It makes sense for the user to do this when the signal indicating the need to clean the shaving apparatus is emitted. From DE 44 02 236 a cleaning device for a shaving apparatus is known, which comprises a coil controllable by a control device, by means of which the shaving apparatus can be (de-)energized, which for this purpose is provided with a reed switch. Furthermore, the cleaning device contains a sensor for detecting whether the shaving apparatus is connected to the electrical supply. The power supply of the shaving device being inserted in the cleaning device is made by means of a lever arm the end of which establishes a current condition between contact pins of the shaving apparatus and the cleaning device.

It is the object of the present invention to make data transmission between a shaving apparatus and a cleaning device as simple as possible.

According to the invention it is possible for a controller inside the shaving apparatus to be connected via the mounting device to the cleaning device in such a way as to enable the transmission of a signal as well. This can be accomplished, for example, by arranging for this signal to be transmitted via the shaving apparatus contact for the power plug. When this signal is then relayed to the cleaning device, a cleaning operation can be started by first moving the shaving apparatus as necessary into a predetermined cleaning position inside the mounting device, followed by activation of the cleaning device.

An embodiment of the present invention is illustrated in greater detail in the accompanying drawings. In the drawings, FIG. 1 shows a measuring system for detecting signals on a shaving apparatus;

Figure 1:
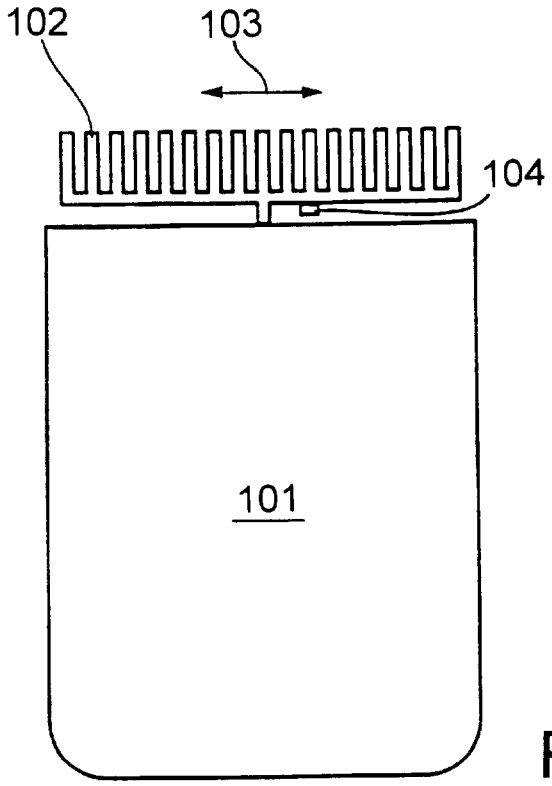
FIG. 1A shows another embodiment of the invention.

FIG. 1 shows a measuring system 104 and 105 for detecting signals on a shaving apparatus 101. The shaving apparatus 101 has a housing accommodating, for example, a storage battery and a mains voltage transformer. Also received in this housing is a motor that can be designed as a DC motor. In the illustrated shaving apparatus 101, this motor, which s not shown in more detail, drives an inner cutter 102.

The shaving apparatus 101 illustrated in FIG. 1 has a shaving head comprising the inner cutter 102 and an outer cutter not shown in more detail. This outer cutter may be a shaving foil that is fitted to the shaving apparatus 101 by means of a shaving foil carrier. Essential for the invention, however, is the movable part of the shaving head, that is, the inner cutter 102 in the illustrated example. The remaining parts of the otherwise known shaving head are not shown in the interest of better clarity.

The inner cutter 102 is moved back and forth in accordance with the arrow 103 by the motor of the shaving apparatus 101. In conjunction with the shaving foil, which is in mounted condition, this back and forth movement causes the beard hairs to be cut off.

The inner cutter 102 becomes soiled during the shaving operation by tallow and shaving dust settling on this inner cutter 102. At a certain degree of soiling the shaving results are thus impaired.

FIG. 1 also shows that a solid-borne sound sensor 104 can be fitted directly to the movable inner cutter 102. This solid-borne sound sensor 104 can then be used for detecting the noises produced during shaving, enabling frequencies in the solid-borne sound range to be differentiated.

Figure 1A:
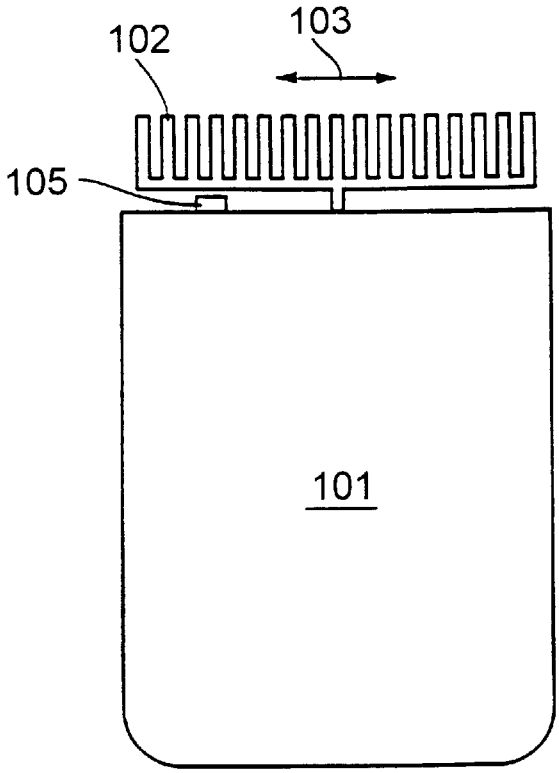

Referring to FIG. 1A, an alternative to the solid-borne sound sensor 104 it is also possible to provide an air-borne sound microphone 105. This air-borne sound microphone 105 can then be used for detecting the noises produced during shaving, enabling frequencies in the audible range to be differentiated.

The shaving apparatus 101 can have a microprocessor, for example, with which it is also possible, for example, to determine the storage battery charge. The signal of the solid-borne sound sensor 104 or of the air-borne noise microphone 105 can be relayed to this microprocessor and then evaluated accordingly in the microprocessor.

An advantage of the air-borne sound microphone 105 is that it can be fitted directly to the housing of the shaving apparatus 101. Transmitting the signal to the microprocessor, which is also located in the shaver housing, is then easier than when using a solid-borne sound sensor 104 requiring the signal to be transmitted via the moving connection between the movable inner cutter 102 and the shaving apparatus 101. When an air-borne sound microphone 105 is used, it is necessary to provide a high-pass filter whose corner frequency can lie at 10 kHz, for example, in order to filter the noises of the running motor which would interfere with the signal evaluation.

A piezoelectric film, for example, can be used as solid-borne sound sensor 104. If the movable inner cutter 102 is constructed as a tubular cutter block mounted on a plastic support, the piezoelectric film can be inserted between the plastic support and the tubular cutter block. With the solid-borne sound sensor 104 fitted directly to the movable inner cutter 102, interfering noises of the running motor have far less an effect. The signal is detected directly without an interfering background. Hence it is also possible under certain circumstances to dispense with signal filtering.

Figure 2:
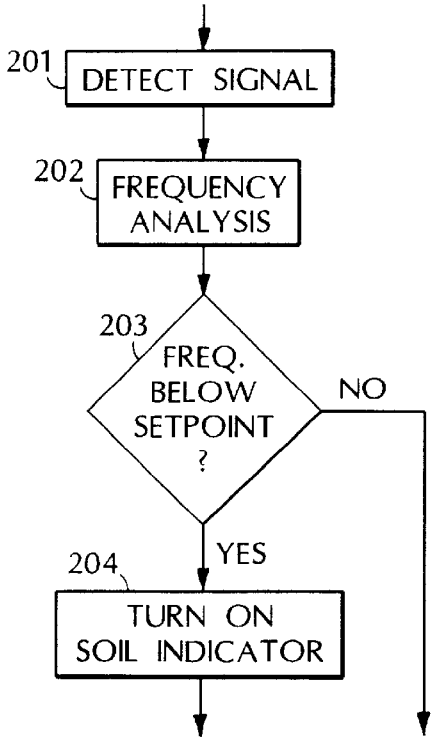
FIG. 2 is a flowchart of a process for signal evaluation.

FIG. 2 shows a flowchart of a process for signal evaluation suitable for deriving the soiling of the shaving apparatus 101.

The signal of the measuring system is detected in step 201.

In step 202 the signal is then subjected to a frequency analysis. This may include, for example, breaking the signal down into its spectral components by means of the fast Fourier transform. It is also possible to determine the power density spectrum. The frequency at which the spectral breakdown of the signal produces a maximum value is then determined. This frequency then corresponds to the natural frequency of the movable inner cutter or outer cutter.

In step 203 this frequency is then compared with a setpoint value of the natural frequency of the movable inner cutter or outer cutter. This setpoint value of the natural frequency corresponds to the natural frequency of the movable inner cutter or outer cutter on a clean shaving apparatus 101. If the determined natural frequency is smaller than the setpoint value of the natural frequency by more than a predetermined threshold value, the routine proceeds to step 204.

If the routine proceeds to step 204, it can be concluded that the drop in the natural frequency was caused by such severe soiling as to make it necessary, or at least advisable, to clean the shaving apparatus 101. A signal is then generated in step 204 either to drive an indicator that can be perceived by the user of the shaving apparatus 101 or to effect cleaning of the shaving apparatus 101.

If the check carried out in step 203 shows that the determined natural frequency is not smaller than the setpoint value of the natural frequency by more than a predetermined threshold value, it can be concluded that there is no need to clean the shaving apparatus. The process sequence can then be ended.

Figure 3:
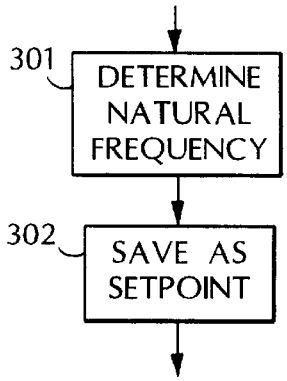
FIG. 3 illustrates an approach for determining the setpoint value.

FIG. 3 shows an approach for determining the setpoint value.

In the simplest case the setpoint value for the movable inner cutter or outer cutter of a particular type of shaving apparatus is predetermined. This approach is very easy to implement because this setpoint value needs to be saved in the microprocessor only for a particular type of shaving apparatus.

In the flowchart shown in FIG. 3, on the other hand, it is possible to compensate for those tolerances in the manufacture of the movable inner or outer cutters which exert an influence on the natural frequency.

This entails determining the natural frequency in step 301 when the shaving apparatus 101 is initially started, and saving this value of the natural frequency in step 302 as the setpoint value.

This setpoint value is used subsequently together with the currently determined natural frequency in the sequence according to FIG. 2.

The initial start-up can take place in the manufacturer's factory as part of a function test or it can take the form of the first start-up by the user.

Figure 4:
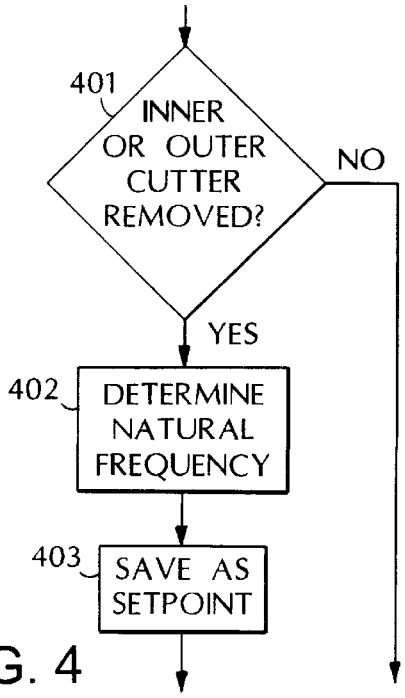
FIG. 4 illustrates a further approach for determining the setpoint value.

In the flowchart shown in FIG. 4 it is equally possible to compensate for those tolerances of the movable inner cutter or outer cutter which have an effect on the natural frequency. In this case the setpoint value is adapted advantageously also when the movable inner cutter or outer cutter is replaced during the service life of the shaving apparatus 101. The setpoint value is not kept to a once predetermined value.

This entails checking in step 401 whether the movable inner cutter or outer cutter was removed. If it was not removed, the sequence according to FIG. 4 is ended.

If, on the other hand, the movable inner cutter or outer cutter was removed, the natural frequency is first determined in step 402 and this value of the natural frequency saved as the setpoint value in step 403.

This setpoint value is used subsequently together with the currently determined natural frequency in the sequence according to FIG. 2.

Figure 5:
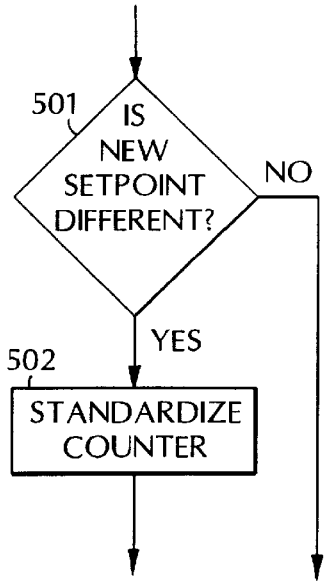
FIG. 5 illustrates an approach for indicating the need to replace the movable inner cutter or outer cutter.

Once the new setpoint value is determined by the method according to claim 4, it is possible, in accordance with the sequence shown in FIG. 5 to determine whether the movable inner cutter or outer cutter was replaced. A further possibility is, namely, that the movable inner cutter or outer cutter was removed for cleaning, after which it was reinserted again. In this case, therefore, the newly determined setpoint value will correspond to the previous setpoint value. Depending on the degree of variation of the setpoint value with the manufacturing tolerance, it is also conceivable to conclude from the deviation of the newly determined setpoint value from the previous setpoint value, after the movable inner cutter 102 or outer cutter is inserted, whether the movable inner cutter 102 or outer cutter is the same one as before or whether a new inner cutter 102 or outer cutter was inserted. Hence in step 501 a check is carried out to establish whether the new setpoint value deviates from the old setpoint value by more than a predetermined threshold value. If it does it can be concluded that a new movable inner cutter or outer cutter was inserted. In this case step 502 will entail standardizing a counting device or some other device by means of which the need to replace the movable inner cutter or outer cutter is to be determined.

Figure 6:
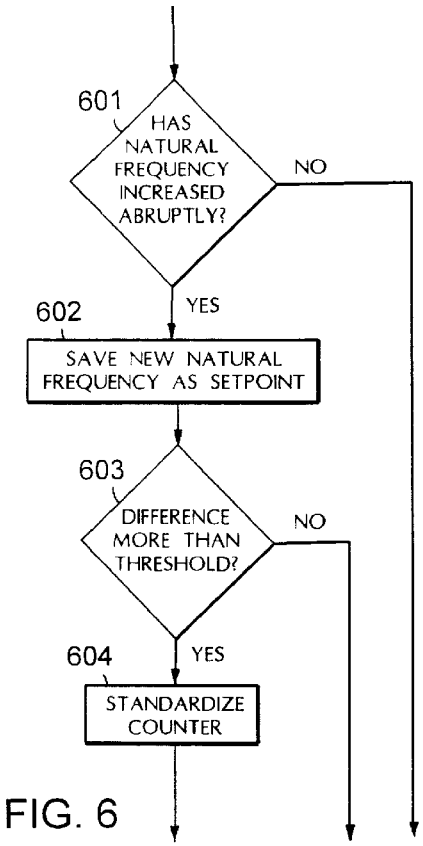
FIG. 6 illustrates a further approach for determining the setpoint value and for indicating the need to replace the movable inner cutter or outer cutter.

With the flowchart shown in FIG. 6 it is equally possible to compensate for tolerances of the movable inner or outer cutters which exert an effect on the natural frequency. In this case the setpoint value is adapted advantageously also when the movable inner or outer cutter is replaced during the service life of the shaving apparatus 101. Hence the setpoint value is not kept to a once predetermined value.

The setpoint value is first determined during the initial start-up as explained in connection with FIG. 3, for example.

In step 601 a check is carried out to see whether the natural frequency now determined during operation has increased abruptly compared with the natural frequency during the previous shave. In other words, a check is carried out to see whether the currently determined natural frequency is greater by more than a predetermined amount than the natural frequency determined during the previous shave. If it is not, the sequence according to FIG. 6 is ended.

If it is, on the other hand, it can be concluded that either a new movable inner or outer cutter has been inserted or that the previously used inner or outer cutter has been cleaned. Hence the current value of the natural frequency is saved in step 602 as the new setpoint value of the natural frequency.

This new setpoint value is used subsequently together with the currently determined natural frequency in the sequence according to FIG. 2.

Once the new setpoint value is determined it is possible to establish further whether the movable inner or outer cutter was replaced. It is possible that the movable inner cutter 102 or outer cutter was removed for cleaning, after which it was re-inserted again. In this case, therefore, the newly determined setpoint value will correspond to the previous setpoint value. Depending on the degree of variation of the setpoint value with the manufacturing tolerance, it is also conceivable to conclude from the deviation of the newly determined setpoint value from the previous setpoint value, after an abrupt change of the natural frequency in the form of a rise in frequency, whether the movable inner cutter 102 or outer cutter is the same one as before or whether a new inner cutter 102 or outer cutter was inserted. Hence in step 603 a check is carried out to establish whether the new setpoint value deviates from the old setpoint value by more than a predetermined threshold value. If it does it can be concluded that a new movable inner or outer cutter was inserted. In this case step 604 will entail standardizing a counting device or some other device by means of which the need to replace the movable inner cutter or outer cutter is to be determined.

Figure 7:
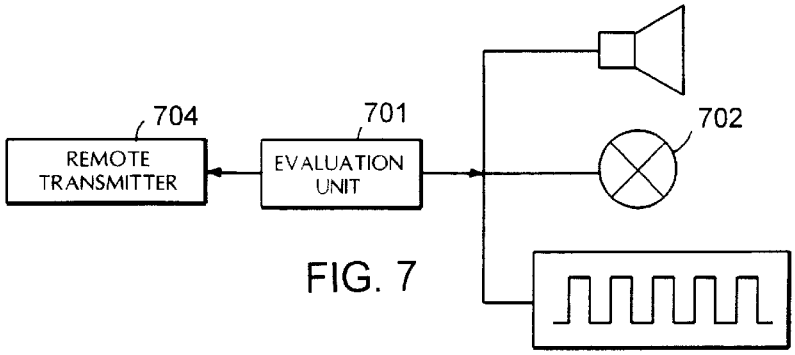
FIG. 7 shows an arrangement for indicating to the user the need to clean and/or replace the movable inner cutter or outer cutter.

FIG. 7 shows an evaluation unit 701, which can be a microprocessor, for example, in the housing of the shaving apparatus. A signal can be issued by this microprocessor to an output device 702, for example, when the need to clean the shaving apparatus 101 has been recognized. It is also possible for a signal to be emitted when the need to replace the movable inner or outer cutter has been recognized. The signal can be output by visual, audible and/or haptic means for example, by speed pulsing. It is an advantage if the user continues receiving the audible or visual signal for a certain time after the shaving apparatus 101 is switched off.

Figure 8:
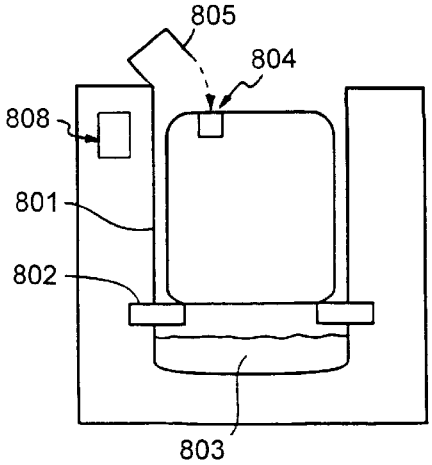
FIG. 8 is a view of a cleaning device suitable for receiving a shaving apparatus.

FIG. 8 shows a cleaning device 801 into which the shaving apparatus 101 can be inserted. This is done, for example, by inserting the shaving apparatus 101 with its shaving head pointing down. If the need to clean the shaving apparatus 101 has been recognized, a signal can be emitted by the evaluation unit 701 inside the shaving apparatus 101 via the power connection 804 of the shaving apparatus 101. The cleaning device 801 is connected by an electrical connector 805 to this power connection 804 of the shaving apparatus 101. It is thus possible for this signal from the evaluation unit 701 to be transmitted to the cleaning device 801. It is also conceivable, however, for the signal from the evaluation unit 701 to be fed to the cleaning device 801 by a remote data transmitter 704 (shown in FIG. 7) and a receiver 808 in cleaning device 801 to receive the signal. In the embodiment shown, the cleaning device 801 has retention pins 802 which hold the shaving apparatus 101 in an upper position when there is to be no cleaning and the cleaning device 801 is to be used solely for storing the shaving apparatus 101. If the signal is emitted by the evaluation unit 701, these retention pins 802 are retracted by electromagnets, for example, and the shaving apparatus 101 is moved into a lower position. In this case the cleaning device 801 also starts to work, meaning, for example, that the cleaning fluid 803 inside the cleaning unit 801 is circulated in order to clean the shaving apparatus 101.

What is claimed is:

1. A method for data transmission between a shaving apparatus and a cleaning device which functions to clean the shaving apparatus, said shaving apparatus including a power connection and further including a device for determining soiling of the shaving apparatus, said cleaning device including an electrical connector that electrically couples to the power connection of the shaving apparatus, said method comprising:

outputting a soiling signal from the device for determining soiling; and transmitting the soil signal via the power connection of said shaving apparatus and the cleaning device electrical connector to said cleaning device.

2. A method for data transmission between a shaving apparatus and a cleaning device which functions to clean the shaving apparatus, said shaving apparatus including a device for determining soiling of the shaving apparatus, said method comprising:

outputting a soiling signal from the device for determining soiling; and transmitting by remote data transmission the soiling signal to said cleaning device.

3. The method as claimed in claim 1 or 2, further comprising automatically starting the cleaning device and thereby cleaning of the shaving apparatus upon receipt of the soiling signal by the cleaning device.

4. Cleaning device for use with a shaving apparatus that includes a power connection, said cleaning device comprising:

an electrical connector that is connectable to the shaving apparatus via the power connection on the shaving apparatus; and a receiver for receiving a cleaning signal from the shaving apparatus via the power connection.

5. Cleaning device comprising a remote data receiving device for receiving a cleaning signal that is transmitted by a remote data transmitter in a shaving apparatus.

6. Shaving apparatus comprising a power connection through which power is delivered thereto during operation, and a device for determining soiling of the shaving apparatus and outputting a soiling signal via the power connection of said shaving apparatus.

7. Shaving apparatus comprising a remote data transmitter, and a device for determining soiling of the shaving apparatus and for sending a soiling signal to remote data transmitter for transmission to a cleaning device.

* * * * *